US012296863B2

(12) United States Patent
Minne

(10) Patent No.: US 12,296,863 B2
(45) Date of Patent: May 13, 2025

(54) CABLE VEHICLE TRANSPORT FACILITY AND METHOD FOR MEASURING AN INFORMATION ITEM RELATING TO SUCH A FACILITY

(71) Applicant: POMA, Voreppe (FR)

(72) Inventor: Guillaume Minne, Grenoble (FR)

(73) Assignee: POMA, Voreppe (FR)

( * ) Notice: Subject to any disclaimer, the term of this patent is extended or adjusted under 35 U.S.C. 154(b) by 840 days.

(21) Appl. No.: 17/427,686

(22) PCT Filed: Mar. 5, 2020

(86) PCT No.: PCT/FR2020/050452
§ 371 (c)(1),
(2) Date: Aug. 2, 2021

(87) PCT Pub. No.: WO2020/178532
PCT Pub. Date: Sep. 10, 2020

(65) Prior Publication Data

US 2022/0126884 A1 Apr. 28, 2022

(30) Foreign Application Priority Data

Mar. 5, 2019 (FR) ..... 1902212

(51) Int. Cl.
*B61B 12/06* (2006.01)
*B61B 12/02* (2006.01)

(52) U.S. Cl.
CPC ..... *B61B 12/06* (2013.01); *B61B 12/02* (2013.01)

(58) Field of Classification Search
CPC ..... B61B 12/06; B61B 12/02
See application file for complete search history.

(56) References Cited

U.S. PATENT DOCUMENTS 5,581,180 A * 12/1996 Ito ..... B61B 12/02 324/207.2
7,328,608 B2 * 2/2008 Kashiwai ..... B60C 23/0408 73/146
11,518,418 B2 * 12/2022 Moritzhuber ..... B61B 12/105
2011/0073000 A1 3/2011 Thum
2016/0082772 A1 * 3/2016 Biderman ..... B60K 7/00 301/6.5

FOREIGN PATENT DOCUMENTS

CN 101 698 409 A 4/2010
CN 205662182 U * 10/2016
EP 0 771 709 A1 5/1997
JP 2017133897 A * 8/2017
WO 95/30216 A1 11/1995
WO 2009/112564 A1 9/2009

OTHER PUBLICATIONS

Aug. 20, 2020 International Search Report issued in International Patent Application No. PCT/FR2020/050452.

* cited by examiner

*Primary Examiner* — Robert J McCarry, Jr.
(74) *Attorney, Agent, or Firm* — Oliff PLC

(57) ABSTRACT

A vehicle transportation installation by cable comprising a cable for hauling a vehicle, a fixedly mounted frame, a bull-wheel coupled to the cable and fitted rotatably on the frame so as to enable the cable to be driven, and a measurement device configured to measure at least one data item concerning movement of the bull-wheel, the measurement device being installed on the bull-wheel.

12 Claims, 2 Drawing Sheets

CABLE VEHICLE TRANSPORT FACILITY AND METHOD FOR MEASURING AN INFORMATION ITEM RELATING TO SUCH A FACILITY

BACKGROUND OF THE INVENTION

The invention relates to vehicle transportation installations by cable, and more particularly to vehicle transportation installations by aerial hauling cable.

PRIOR ART

Pulleys are currently used to drive hauling cables for transporting vehicles, in particular for transportation installations such as aerial cable cars, for example chairlifts, gondola lifts or draglifts. The pulleys can be drive pulleys, called bull-wheels, and they are then coupled to a motor that drives them in rotation. The pulleys can also be pulleys called "return pulleys" to enable the hauling cable to return to the drive bull-wheel, or they can be deflection pulleys to deflect the hauling cable.

In order to run and maintain the installations in complete safety, the operators monitor useful data originating from different instruments. The useful data can be the speed of the hauling cable, the distance travelled, or the vibrations of the pulleys. For example, a rotary encoder sheave is used in contact with the hauling cable to deduce the speed of the hauling cable and the distance travelled. Controllers coupled to the motors that drive the bull-wheels are also used to record data on the speed of rotation of the bull-wheels. Furthermore, vibration sensors comprising accelerometers can be used to measure vibrations of the pulleys or bull-wheels. The vibration sensors are positioned on a fixed rotary shaft of the pulley. Instruments can also be used for detecting tilting of the rotation axis of a pulley or bull-wheel. These instruments comprise two blades located inside the groove of a pulley, and as soon as one rim of the groove comes into contact with a blade, the instrument detects tilting of the rotation axis.

But all these instruments are not connected to a single interface enabling all the data useful for operation and maintenance of the installation to be monitored. Furthermore, a ski resort is complex and may comprise several cable transportation installations, such as for example several chairlifts, gondola lifts and draglifts, which means that a large number of instruments are required to monitor operation of the whole of the ski resort. A requirement therefore exists to centralise the data in order to monitor the parameters of an installation.

OBJECT OF THE INVENTION

One object of the invention consists in remedying these drawbacks and more particularly in providing simple means for retrieving data useful for maintenance and operation of a vehicle transportation installation by cable.

According to one feature of the invention, a vehicle transportation installation by cable is proposed comprising a cable to haul a vehicle, a fixedly mounted frame, a bull-wheel coupled to the cable and mounted rotatable on the frame so as to be able to drive the cable, and a measurement device configured to measure at least one data item concerning movement of the bull-wheel.

The measurement device is mounted on the bull-wheel.

Such an installation enables useful data, such as for example the speed, acceleration or vibrations of a bull-wheel driving the cable, to be retrieved in very simple manner. The interfaces of the existing instruments of the installation used under normal conditions to retrieve certain useful data also do not need to be modified. In addition, useful data for installations not equipped with sensors, such as for example most draglifts, or older installations such as non-detachable chairlifts, can also be retrieved very easily.

The measurement device can comprise a wireless communication means configured to transmit said at least one measured data item outside the measurement device.

According to one embodiment, the measurement device comprises a magnet configured to install the measurement device in removable manner on the bull-wheel.

It is not necessary to modify the bull-wheel, which means that the measurement device can be installed very quickly. Nor is it necessary to use tools to install the measurement device, nor to perform long and complex operations such as soldering operations for example.

According to another embodiment, the measurement device comprises a surface and an adhesive product placed on the surface to secure the measurement device in fixed manner on the bull-wheel.

The measurement device can further comprise a gyroscope configured to measure at least an angular speed and at least an angular acceleration of the bull-wheel along a rotation axis of the bull-wheel.

The measurement device can comprise an accelerometer configured to measure at least a speed and at least an acceleration of the bull-wheel along a translation axis of the bull-wheel.

Advantageously, the measurement device comprises an electronic control unit and a non-volatile memory coupled with the electronic control unit, the electronic control unit being configured to record said at least one measured data item in the non-volatile memory.

The electronic control unit can be configured to compare a new measurement of said at least one data item with the recorded measurement of said at least one data item, and the communication means is configured to transmit the new measurement when the new measurement is different from the recorded measurement.

A measurement device can thus be provided that consumes as little power as possible for its operation.

The communication means can be configured to transmit said at least one recorded data item when the electronic control unit receives a data transmission signal emitted from a remote computer.

According to another feature of the invention, a method is proposed for measuring at least one data item concerning movement of a bull-wheel of a vehicle transportation installation by cable, the installation comprising a fixedly mounted frame, and the bull-wheel being coupled to the cable and mounted rotatable on the frame so as to be able to drive the cable.

The method comprises installation of a measurement device on the bull-wheel and the device measures at least one data item concerning movement of the bull-wheel.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which.

DESCRIPTION OF THE EMBODIMENTS

Figure 1:
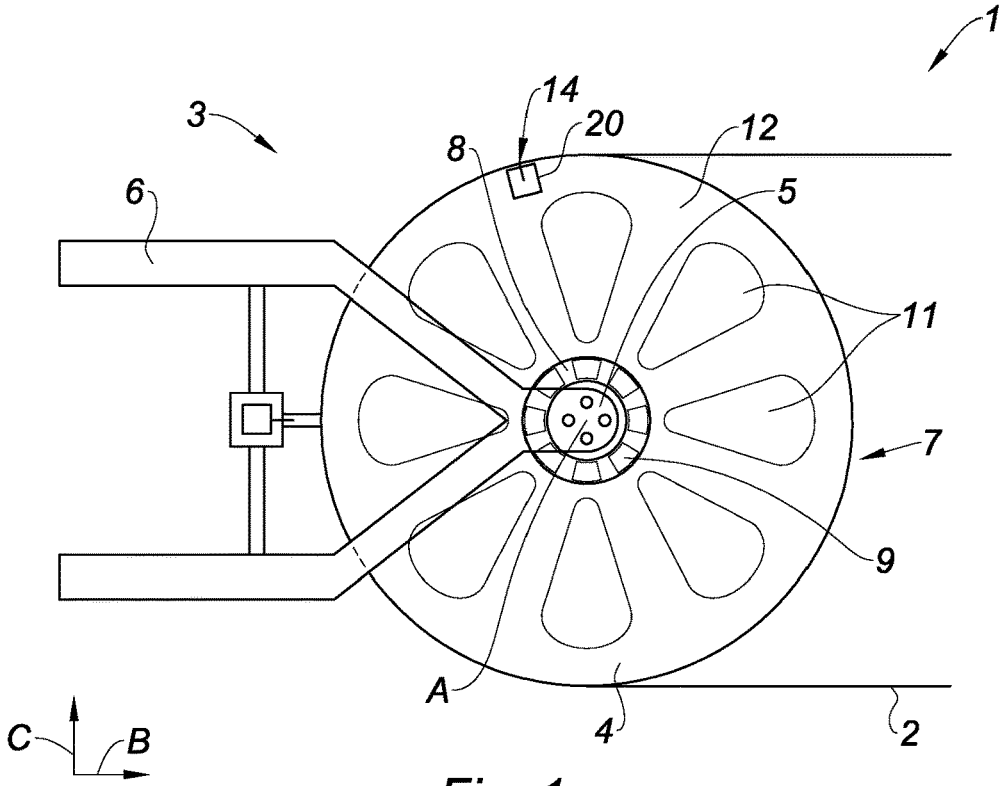
FIG. 1 schematically illustrates a top view of an embodiment of a vehicle transportation installation by cable according to the invention.
Figure 2:
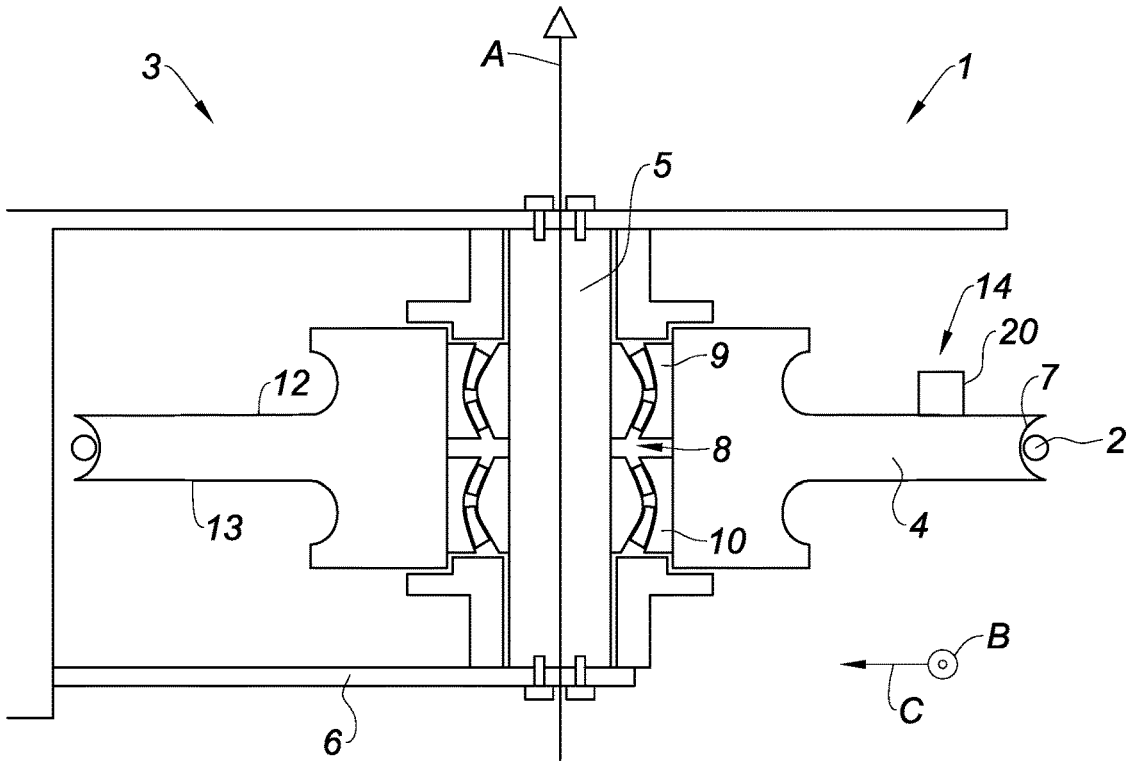
FIG. 2 schematically illustrates a cross-sectional view of the installation illustrated in FIG. 1.
Figure 3:
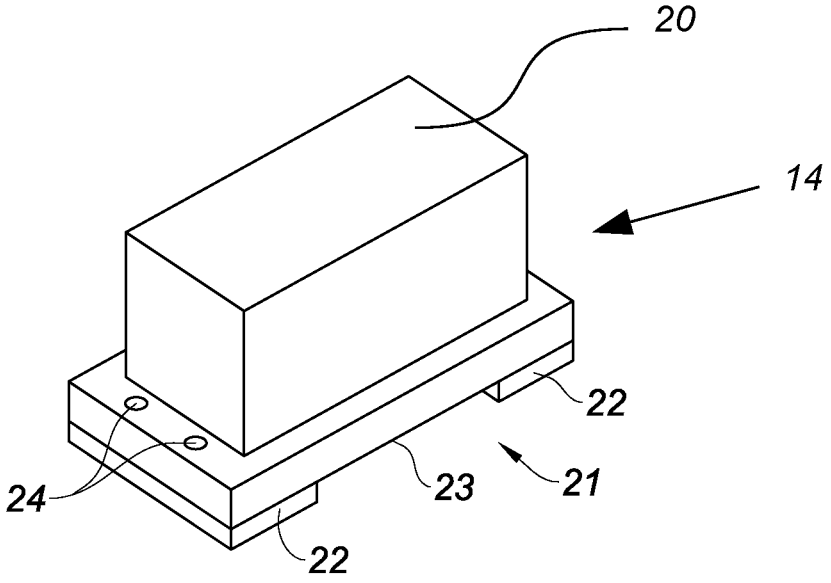
FIG. 3 schematically illustrates an embodiment of a measurement device of the installation.

In FIGS. 1 and 2, a vehicle transportation installation 1 by cable 2 has been represented. The installation 1 can comprise one or more vehicles, not represented for the sake of simplification, and a cable 2 to which the vehicles are coupled in order to be hauled. The installation 1 further comprises terminals where the passengers can board and/or descend from the vehicles. The hauling cable 2 is continuous forming a closed loop and runs between two terminals of the installation 1 to move the vehicles coupled to the cable 2. The vehicles enable passengers to be transported from one terminal of the installation 1 to the other. For the sake of simplification, a single terminal 3 has been represented in FIGS. 2 and 3. The cable 2 is referred to as hauling cable. The installation 1 can be a chairlift, an aerial cable car, a gondola lift, a draglift, a funicular, or an air-cushion train. The hauling cable 2 can be aerial and in this case the installation 1 is of aerial cable car, chairlift, gondola lift or draglift type, or it can be situated at ground level and in this case the installation 1 is of funicular or air-cushion train type.

The installation 1 further comprises a pulley 4 and a frame 6. The frame 6 is mounted stationary in the terminal 3 of the installation 1. The pulley 4 is configured to be coupled to the cable 2. In particular, the pulley 4 comprises a groove 7 configured to receive the cable 2. Furthermore, the pulley 4 is mounted rotatable on the frame 6 so as to be able to drive the cable 2. More particularly, the pulley 4 is rotatable around a rotation axis A. The pulley 4 can be a drive bull-wheel and in this case it is coupled to a motor that drives it in rotation around rotation axis A. The pulley 4 can also be a return pulley, as illustrated in FIGS. 1 and 2, and in this case it enables the cable 2 to be returned to another drive bull-wheel of the installation 1. In other words, a return pulley 4 collaborates with a bull-wheel to place the cable 2 under tension to be able to drive the cable 2 in movement. In general manner, a pulley 4, whether it be a bull-wheel or a return pulley, enables the cable 2 to be driven in translation along a translation axis B. Translation axis B is perpendicular to rotation axis A of the pulley 4. Rotation axis A can be vertical, as illustrated in FIGS. 1 and 2, and in this case the pulley 4 extends horizontally. Rotation axis A can be horizontal, and in this case the pulley 4 extends vertically. More generally, the pulley 4 is a wheel having a diameter that is larger than its height. The pulley 4 can be solid or a central through hole 8 can be formed in the centre of the pulley 4. The frame 6 is a preferably metal structure supporting the pulley 4. The frame 6 is mounted in fixed manner in a terminal 3, i.e. the frame 6 does not rotate. Other eccentric through apertures 11 can be formed in the pulley 4 to reduce the weight of the latter. These eccentric through the apertures 11 are distributed regularly around the rotation axis A. The pulley 4 further comprises two outer surfaces 12, 13. In particular, the outer surfaces 12, 13 are located on each side of the groove 7 of the pulley 4. When the pulley 4 comprises a central through hole 8, each outer surface 12, 13 extends between the groove 7 and one edge of the central through hole 8.

An embodiment of a return pulley 4 has been represented in FIGS. 1 and 2. According to this embodiment, the installation 1 comprises a rotary shaft 5 mounted in fixed manner in the terminal 3 of the installation 1. In particular, the rotary shaft 5 is mounted fixedly on the frame 6 and the rotary shaft 5 does not rotate. The rotary shaft 5 extends along rotation axis A and the pulley 4 is mounted rotatable on the rotary shaft 5. The rotary shaft 5 is housed in the central through hole 8. The rotary shaft 5 passes through the central through hole 8 of the pulley 4 and presents two ends salient from the central through hole 8. Furthermore, the ends of the rotary shaft 5 are mounted fixedly on the frame 6 of the installation 1. The installation 1 further comprises the bearings 9, 10 housed in the central through hole 8. The bearings 9, 10 press against the rotary shaft 5 and against the pulley 4. The bearings 9, 10 enable the pulley 4 to be made to rotate around rotation axis A, i.e. around the rotary shaft 5. The bearings 9, 10 are located around the rotary shaft 5. In other words, the bearings 9, 10 are located between the rotary shaft 5 and the pulley 4. The bearings 9, 10 are components configured to support and guide the pulley 4 in rotation. Preferably, the bearings 9, 10 are ball-bearings equipped with balls or rollers.

As a variant, the pulley 4 can be a drive bull-wheel driven in rotation by a motor. According to this variant, a rotary shaft extends along a longitudinal axis and is mounted fixedly on bull-wheel 4. The rotary shaft is then mounted rotatably inside the motor. The motor is mounted in fixed manner on the frame 6 of the installation 1, and bull-wheel 4 is mounted rotatably on the frame 6, around the longitudinal axis.

More particularly, the installation 1 comprises a measurement device 14 configured to measure at least one data item concerning movement of bull-wheel 4. The measured data is useful for operation and maintenance of the installation 1. More particularly, the measurement device 14 is mounted on bull-wheel 4. The measurement device 14 is therefore driven in rotation when bull-wheel 4 rotates around rotation axis A. The measurement device 14 is therefore mounted movable with respect to the frame 6. More particularly, the measurement device 14 is mounted on an external surface 12, 13 of bull-wheel 4, for example between two eccentric through the apertures 11.

Figure 4:
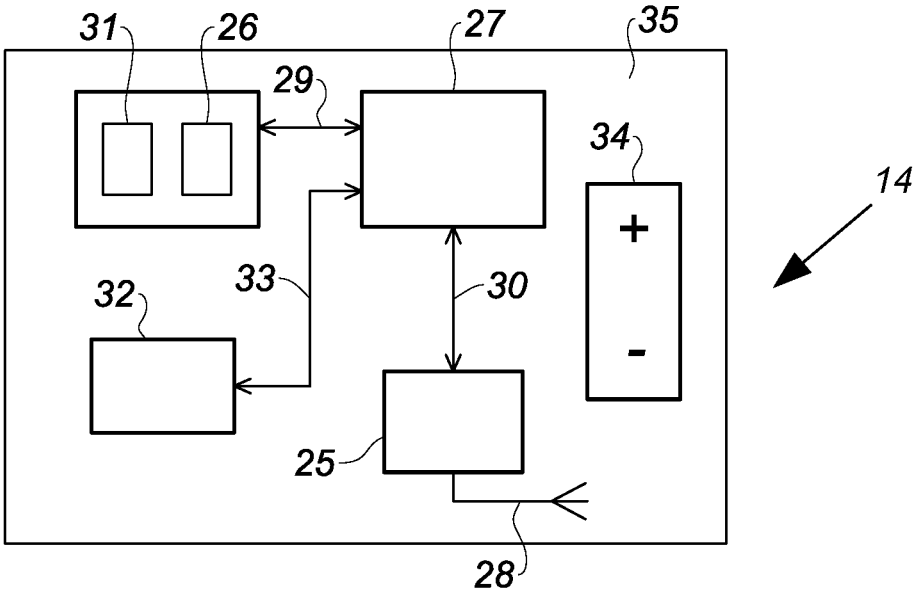
FIG. 4 schematically illustrates another embodiment of the measurement device of the installation.

The measurement device 14 comprises an enclosure 20. Embodiments of the measurement device 14 have been represented in FIGS. 3 and 4. In general manner, enclosure 20 comprises fixing means 21 configured to fix the measurement device 14 on an outer surface 12, 13 of bull-wheel 4. Fixing means 21 can be configured to install the measurement device 14 in removable manner on bull-wheel 4. For example, fixing means 21 comprise one or more magnets 22, for example four magnets 22 distributed regularly on surface 23 of enclosure 20. Magnets 22 can be fixed to surface 23 by means of bolts 24. Magnets 22 are particularly suitable for removable fixture of the measurement device 14 on bull-wheel 4, as in general manner bull-wheel 4 is made from metal. As a variant, fixing means 21 are configured to install the measurement device 14 on bull-wheel 4 in fixed manner. For example, fixing means 21 comprise an adhesive product, such as a glue, to fix the measurement device 14 on bull-wheel 4. The adhesive product is applied on surface 23 of enclosure 20.

The measurement device 14 is configured to measure useful data and to transmit the latter outside enclosure 20.

The measurement device 14 further comprises at least a communication means 25 and a gyroscope 26. Gyroscope 26 is configured to measure at least one data item concerning rotation of bull-wheel 4 along a rotation axis. Gyroscope 26 is preferably configured to measure rotation data of bull-wheel 4 along respectively three rotation axes. For example the three rotation axes are three orthogonal axes defining an orthonormal coordinate system. Rotation data can be an angular speed, noted rotational speed, or an angular acceleration, noted rotational acceleration. What is meant by acceleration is a positive or negative acceleration, negative acceleration also being called braking. Advantageously, gyroscope 26 is configured to measure three angular accelerations and three angular speeds of bull-wheel 4 along respectively three rotation axes of bull-wheel 4. The rotation axes of bull-wheel 4 are preferably orthogonal. The rotation axes of bull-wheel 4 are for example translation axis B, rotation axis A and a third axis C perpendicular to the first two axes A, B. In normal operation, rotation of bull-wheel 4 along axes B and C is small. But in case of abnormal functioning, for example tilt of bull-wheel 4, rotational movements of bull-wheel 4 along translation axis B and third axis C can be measured. Gyroscope 26 is preferably of microelectromechanical system type.

Communication means 25 is configured to transmit the measured data outside the measurement device 14. Communication means 25 is preferentially a wireless means. A wireless communication means 25 is particularly suitable for transmitting the measured data from the measurement device 14 which is driven in rotation when the installation 1 is in operation. Communication means 25 preferentially comprises an antenna 28 for transmitting and receiving signals by radio waves. Communication means 25 is further configured to transmit the measured data to an external electronic unit, not represented for the sake of simplification. The external electronic unit can be a smartphone, an electronic tablet, or a remote computer. The external electronic unit comprises a software interface configured to receive the data transmitted by the measurement device 14 and a readout to display the received data. The external electronic unit enables the measured data to be monitored for operation and maintenance of the installation 1.

The measurement device 14 can also comprise an electronic control unit 27. Electronic control unit 27 is coupled to gyroscope 26 via a connection 29 to perform processing operations on the measured data. Electronic control unit 27 can further be coupled via a connection 30 to communication means 25 to manage sending of the signals containing the measured data and the signals received by communication means 25. Communication means 25 is coupled to gyroscope 26 either directly or via electronic control unit 27.

The measurement device 14 can further comprise an accelerometer 31. Accelerometer 31 is configured to measure at least one translation data item of bull-wheel 4 along a translation axis. Accelerometer 31 is preferably configured to measure translation data of bull-wheel 4 along respectively three translation axes. For example the three translation axes are three orthogonal axes defining an orthonormal coordinate system. Translation data can be a speed, noted translation speed, or an acceleration also noted translation acceleration. Advantageously, accelerometer 31 is configured to measure three accelerations and three speeds of bull-wheel 4 along respectively three translation axes of bull-wheel 4. The translation axes of bull-wheel 4 are preferably orthogonal. The translation axes of bull-wheel 4 are for example translation axis B, rotation axis A and the third axis C. In normal operation, translation of bull-wheel 4 along rotation axis A is small. But in case of abnormal functioning, for example when vibrations or tilting of bull-wheel 4 occur, a translation movement of the bull-wheel along rotation axis A can be measured. Accelerometer 31 is preferably of microelectromechanical system type. Accelerometer 31 can be coupled to electronic control unit 27 via connection 29 or be coupled directly to communication means 25.

Furthermore, electronic control unit 27 can be configured to develop parameters from the measured data. The parameters and measured data are data concerning movement of bull-wheel 4. For example, electronic control unit 27 can develop braking parameters from the speeds and accelerations measured by accelerometer 31 and/or gyroscope 26. For example, electronic control unit 27 can develop a braking distance, a braking time, an initial braking rate, and a braking curve corresponding to the speeds of bull-wheel 4 versus time when braking takes place. The braking distance corresponds to the distance travelled by the cable 2 when braking of bull-wheel 4 is performed. Electronic control unit 27 can further develop vibration parameters of bull-wheel 4 from the measured accelerations. Electronic control unit 27 can further develop a number of rotations performed by bull-wheel 4 from at least one measured rotation data item. Electronic control unit 27 can further develop a direction of rotation of bull-wheel 4 from the measured rotation data.

According to another advantage, the measurement device 14 comprises an electric power storage unit 34 and a non-volatile memory 32 coupled via a connection 33 to electronic control unit 27. Electric power storage unit 34 supplies power to the components of the measurement device 14, i.e. accelerometer 31, gyroscope 26, electronic control unit 27, communication means 25 and memory 32. According to an embodiment illustrated in FIG. 4, the components of the measurement device 14 are electronic components mounted on a printed circuit board 35. Printed circuit board 35 is housed inside enclosure 20.

Electronic control unit 27 can be configured to record the measured data and the parameters developed in non-volatile memory 32. Communication means 25 can also be configured to transmit the developed parameters outside the measurement device 14. The measurement device 14 can be configured to periodically transmit the measured data to the external electronic unit.

Advantageously, communication means 25 is configured to transmit the recorded data on a specific request, for example when electronic control unit 27 receives a data transmission signal transmitted by the external electronic unit. As a variant, electronic control unit 27 is configured to compare the new data measurement with the recorded data measurement, and communication means 25 is configured to transmit the new measurement when it is different from the recorded measurement. In this way, the recorded data is only communicated to outside device 14 on a specific request from the external electronic unit, or when a specific event occurs, for example a data item that changes value. A saving is thus made on the power consumption of storage unit 34. As a variant, the installation 1 can comprise several measurement devices 14 to ensure data transmission security. It is also possible to fit a the measurement device 14 on at least one pulley 4, either a bull-wheel or a return pulley, of each the installation 1 of a ski resort. It is thus possible to monitor the useful data of a complex ski resort comprising a large number of installations.

A method for measuring at least one data item concerning movement of pulley or bull-wheel 4 can be implemented by the system that has been described in the foregoing. The method comprises installation of the measurement device 14 on pulley or bull-wheel 4 and measurement by the measurement device 14 of at least one data item concerning movement of pulley or bull-wheel 4. The method is simple and enables data useful for operation and maintenance of the installation 1 to be monitored very quickly. The necessity of developing complex software interfaces to communicate with pre-existing measurement instruments in the installation 1 is thus circumvented. Furthermore, the measurement device 14 according to the invention does not require the equipment of the installation 1 to be modified.

The invention claimed is:

1. A vehicle transportation installation by cable, comprising:

a cable to haul a vehicle, a frame mounted stationary, a bull-wheel coupled to the cable and mounted rotatable on the frame so as to be able to drive the cable, and a measurement device mounted on the bull-wheel and configured to measure at least one data item concerning movement of the bull-wheel, wherein the measurement device comprises:

a gyroscope configured to measure at least an angular speed and at least an angular acceleration of the bull-wheel along a rotation axis of the bull-wheel and/or an accelerometer configured to measure at least a speed and at least an acceleration of the bull-wheel along a translation axis of the bull-wheel, and an electronic control unit configured to develop parameters from the measured data, the parameters being braking parameters developed from the speeds and accelerations measured by the accelerometer and/or gyroscope, the braking parameters comprising at least one of a braking distance, a braking time, an initial braking rate, and a braking curve, the braking curve corresponding to the speeds of the bull-wheel versus time when braking takes place, the braking distance corresponding to the distance travelled by the cable when braking of the bull-wheel is performed.

2. The vehicle transportation installation by cable according to claim 1, wherein the measurement device comprises a communication device formed by a wireless communication device configured to transmit said at least one measured data item outside the measurement device.

3. The vehicle transportation installation by cable according to claim 2, wherein the measurement device comprises an electronic control unit and a non-volatile memory coupled to the electronic control unit, the electronic control unit being configured to record said at least one measured data item in the non-volatile memory.

4. The vehicle transportation installation by cable according to claim 3, wherein the electronic control unit is configured to compare a new measurement of said at least one data item with the recorded measurement of said at least one measured data item, and the wireless communication device is configured to transmit the new measurement when the new measurement is different from the recorded measurement.

5. The vehicle transportation installation by cable according to claim 4, wherein the wireless communication device is configured to transmit said at least one recorded data item when the electronic control unit receives a data transmission signal transmitted from a remote computer.

6. The vehicle transportation installation by cable according to claim 3, wherein the wireless communication device is configured to transmit said at least one recorded data item when the electronic control unit receives a data transmission signal transmitted from a remote computer.

7. The vehicle transportation installation by cable according to claim 1, wherein the measurement device comprises a magnet configured to install the measurement device in removable manner on the bull-wheel.

8. The vehicle transportation installation by cable according to claim 1, wherein the measurement device comprises a surface and an adhesive product placed on the surface to secure the measurement device in stationary manner on the bull-wheel.

9. The vehicle transportation installation by cable according to claim 1, wherein the measurement device comprises the gyroscope configured to measure at least an angular speed and at least an angular acceleration of the bull-wheel along a rotation axis of the bull-wheel.

10. The vehicle transportation installation by cable according to claim 1, wherein the measurement device comprises the accelerometer configured to measure at least a speed and at least an acceleration of the bull-wheel along a translation axis of the bull-wheel.

11. The vehicle transportation installation by cable according to claim 1, wherein the measurement device comprises the gyroscope configured to measure at least an angular speed and at least an angular acceleration of the bull-wheel along a rotation axis of the bull-wheel, and comprises the accelerometer configured to measure at least a speed and at least an acceleration of the bull-wheel along a translation axis of the bull-wheel.

12. A method for measuring at least one data item concerning movement of a bull-wheel in a vehicle transportation installation by cable, comprising:

providing the vehicle transportation installation comprising a frame mounted stationary and a bull-wheel coupled to a cable and mounted rotatable on the frame so as to be able to drive the cable, installing a measurement device on the bull-wheel, the measurement device measuring at least one data item concerning movement of the bull-wheel, wherein the measurement device comprises:

a gyroscope configured to measure at least an angular speed and at least an angular acceleration of the bull-wheel along a rotation axis of the bull-wheel and/or an accelerometer configured to measure at least a speed and at least an acceleration of the bull-wheel along a translation axis of the bull-wheel; and an electronic control unit configured to develop parameters from the measured data, the parameters being braking parameters developed from the speeds and accelerations measured by the accelerometer and/or gyroscope, the braking parameters comprising at least one of a braking distance, a braking time, an initial braking rate, and a braking curve, the braking curve corresponding to the speeds of the bull-wheel versus time when braking takes place, the braking distance corresponding to the distance travelled by the cable when braking of the bull-wheel is performed.

* * * * *